United States Patent [19]

Ruble

[11] Patent Number: 4,681,472

[45] Date of Patent: Jul. 21, 1987

[54] SELF-LOADING BINDER

[76] Inventor: Paul E. Ruble, 924 Oakmound St., Newbury Park, Calif. 91320

[21] Appl. No.: 859,005

[22] Filed: May 2, 1986

[51] Int. Cl.[4] ..... B42F 1/00; B42F 1/06; B65H 23/00; B42D 19/00

[52] U.S. Cl. ..... 402/3; 402/4; 226/6; 281/5

[58] Field of Search ..... 402/3, 4; 400/529, 530, 400/532; 226/1, 6, 7; 206/390, 607; 281/5

[56] References Cited

U.S. PATENT DOCUMENTS

| | | | |
|---|---|---|---|
| 1,805,314 | 5/1931 | Morton | 402/3 |
| 3,186,114 | 6/1965 | Carter | 402/3 |
| 3,663,041 | 5/1972 | White . | |
| 3,814,527 | 6/1974 | Lawes . | |
| 4,070,223 | 1/1978 | Stalzer | 226/6 |
| 4,448,558 | 5/1984 | Weingarten | 226/6 |
| 4,596,482 | 6/1986 | Salzer | 402/3 |

FOREIGN PATENT DOCUMENTS

| | | | |
|---|---|---|---|
| 1536573 | 1/1970 | Fed. Rep. of Germany | 402/3 |

*Primary Examiner*—E. R. Kazenske
*Assistant Examiner*—Paul M. Heyrana, Sr.
*Attorney, Agent, or Firm*—Koppel & Harris

[57] ABSTRACT

A system is disclosed for locating a label on the spine of a bound work. An elongate leader extends through a slot formed when an overlay cover is placed on and sealed to the spine of the bound work, and out each end of the slot. The leader includes an adhesive portion in the vicinity of one end onto which a label can be affixed. The leader is pulled longitudinally through the slot, causing the label to enter the slot through one transverse edge. Pressure is then applied to the label via the overlay cover, and the force on the leader is continued until the leader separates from the label, leaving the label at a desired position along the spine of the bound work. The label can be removed from the spine in a similar fashion by sliding the adhesive portion of the leader through one transverse edge of the slot until it adheres to the label. The leader and label are then withdrawn from the slot. The system allows the placement and removal of a label from a slot located on the spine of a bound work without damaging the label during the insertion or removal, and also ensures that the label will not be worn or inadvertently removed from the spine until intended.

10 Claims, 7 Drawing Figures

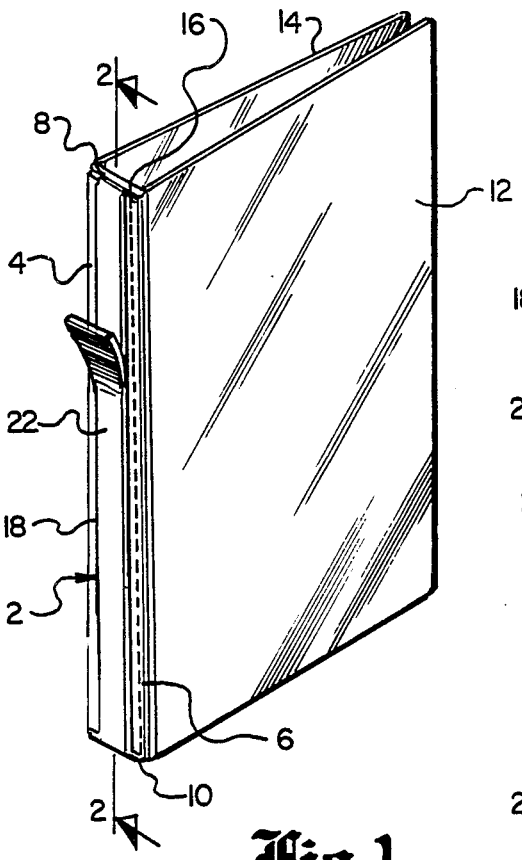
Fig.1.
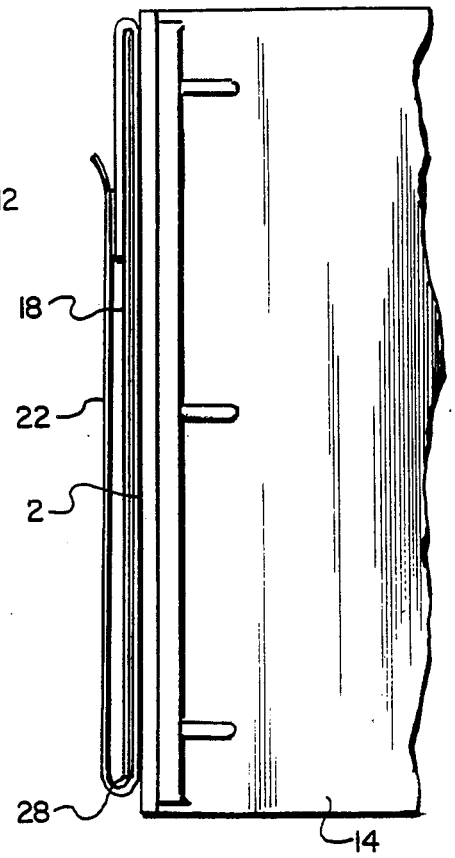
Fig.2.
Fig.3.
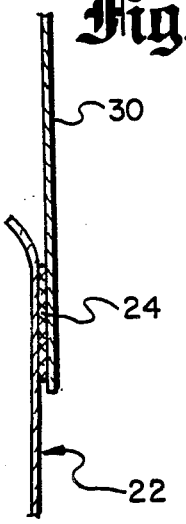
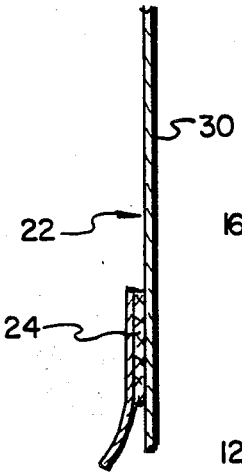
Fig.4.
Fig.5.
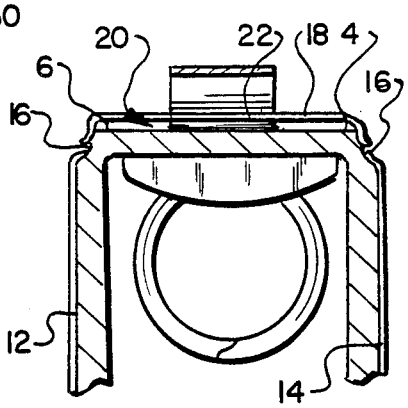

SELF-LOADING BINDER

BACKGROUND OF THE INVENTION

1. Field of the Invention

This invention is an improved system for identifying bound works by labeling the spine of the works and, more specifically, an improved system for locating the label on the spine of a looseleaf binder.

2. Description of the Prior Art

When several similar binders are used, each containing different contents, it is necessary to label the binders so that they may be distinguished. Binders are usually indentified by attaching a label to the spine and/or the front of each binder.

Several methods of identifying binders exist. One method involves labels which are adapted for writing on one side and contain an adhesive substance on the opposite side. After identifying marks are made on the side adapted for writing the adhesive side of the label is placed onto the spine of the binder. Over time these labels tend to easily wear out and the corners of the labels begin to pull away from the spine of the binder. With the passage of time notations on the label become illegible and the labels must be replaced.

Another common method of identifying binders comprises placing a label into a transparent pocket section located on the spine of the binder. The pocket section can occupy a portion of the spine or it can extend the entire length of the spine. The pocket section is usually attached to the spine along three edges, allowing the label to be inserted into the pocket through the unattached edge.

One system of placing a label into a transparent section on a spine is disclosed in U.S. Pat. No. 3,663,041 (1972) to White. The system includes a spine assembly comprised of a window or flange which receives a label or similar identifying means. The window includes a transparent section and is located over the spine of the bound work. A label is pushed down in-between the spine and the window, and is viewed through the transparent section of the window. Flanges located along each longitudinal edge of the spine may be substituted for the window. Each flange is an L-shaped member which is oriented to hold the label when the label is placed between the flanges.

When using the window alternative of the White patent, it is difficult to place the label between the window and the spine without jamming the label into place and subsequently damaging the label. Once the label is in place it is even more difficult to remove or to replace with another label.

The use of the flange alternative of the White patent eliminates the problem evident with the window alternative, but creates problems of its own. As with the adhesive labels, the labels held by the flange tend to wear easily, and tend to be pushed out from between the flanges and detached from the spine.

Another system for placing a label into a transparent section of the spine is disclosed in U.S. Pat. No. 3,814,527 (1974) to Lawes. This patent discloses a system using two covers and an outer curved spine. The inner cover includes paper retaining means, used to hold a label or similar identifying means. The outer cover is located over the inner cover and comprises removable portions defined by line welds which are created during the production of the outer cover. The removable portions are located longitudinally along the outer cover and, when they are removed, form a window through which a label inserted into the inner cover is visible.

The label is pushed in-between the inner and outer covers and is located at a desired location along the spine. The appropriate removable portion is then peeled back to expose the legend on the label.

The deficiencies of this system are similar to those discussed above. While the label is being placed into the pocket the edges of the label are prone to damage, and folds are frequently created in the center of the label by the force used to push the labels into the pocket. Removal of the label from the pocket is even more difficult. Additional damage is done to the transparent pocket and the label when pens, paper clips and other items are used to fish a label lodged into the pocket.

SUMMARY OF THE INVENTION

In view of the above problems with the prior art, the object of the present invention is the provision of a novel and improved system that allows for identifying bound works such as looseleaf binders by labeling the spine of the binder.

A further object of the present invention is to provide a labeling system that allows for the placing and removal of the label from the slot located on the spine of the binder, without causing damage to the label or to the slot. An additional object is to protect the label from wear and to limit the possibility of removing the label from the slot until intended. The invention is also intended to provide a more convenient mechanism for inserting a label into a spine slot, and for accurately positioning the label at any desired location within the slot, even locations that are remote from the ends of the slot and cannot be reached by finger.

The present invention provides an improved system for locating a label on the spine of a bound work by means of a leader which is located in a slot formed by an overlay cover which is sealed to the longitudinal edges of the spine. The leader extends out of the slot beyond each transverse edge of the overlay cover. One end of the leader is adapted to be attached to a label, such as by an adhesive portion on the end of the leader; the other end is adapted to pull the leader and the attached label through the slot until the label is positioned in a desired location.

In the preferred embodiment the leader comprises an elongate member with a width less than the width of the spine, and the slot is formed by high frequency sealing the overlay cover to the spine along its longitudinal edges. At least part of the transverse edges of the overlay cover are not sealed with respect to the spine, thereby allowing the leader to pass through and extend beyond the overlay cover on each side.

The label is attached to an adhesive portion on one end of the leader. The opposite end of the leader is pulled, causing the leader and the attached label to travel longitudinally through the slot until the label is positioned at a desired location along the spine. After the label is placed at the desired location, finger pressure is applied to the label via the overlay cover. The leader is then firmly drawn and detached from the label. The adhesive portion used is strong enough to hold the label, but is weak enough so that the leader can be detached from the label without damaging the label.

If removal of the label from the slot is desired, the adhesive portion of the leader is placed into the slot through the top transverse edge and is attached to the label. The leader is then withdrawn thus removing the label from the slot.

The use of the present invention allows the simple placement and removal of a label from any desired location within a slot located on the spine of a bound work, without damaging the label during the insertion or removal. The present invention also ensures that the label will not be worn or inadvertently removed from the spine until intended. These and other features and objects of the invention will be apparent to those skilled in the art from the following detailed description of a preferred embodiment, taken together with the accompanying drawings, in which:

BRIEF DESCRIPTION OF THE DRAWINGS

FIG. 1 is an isometric view of a bound work incorporating the present invention;

FIG. 2 is a sectional elevation view taken along line 2—2 of FIG. 1;

FIG. 3 is a fragmentary sectional view of the end of the leader prior to use, with an adhesive portion connected to a waxed portion present on the opposite end of the leader;

FIG. 4 is a fragmentary sectional view of a different embodiment of the leader, with a detachable cover positioned over the adhesive portion;

FIG. 5 is a fragmentary top plan view of a binder incorporating the present invention;

DETAILED DESCRIPTION OF THE PREFERRED EMBODIMENTS

Figure 6:
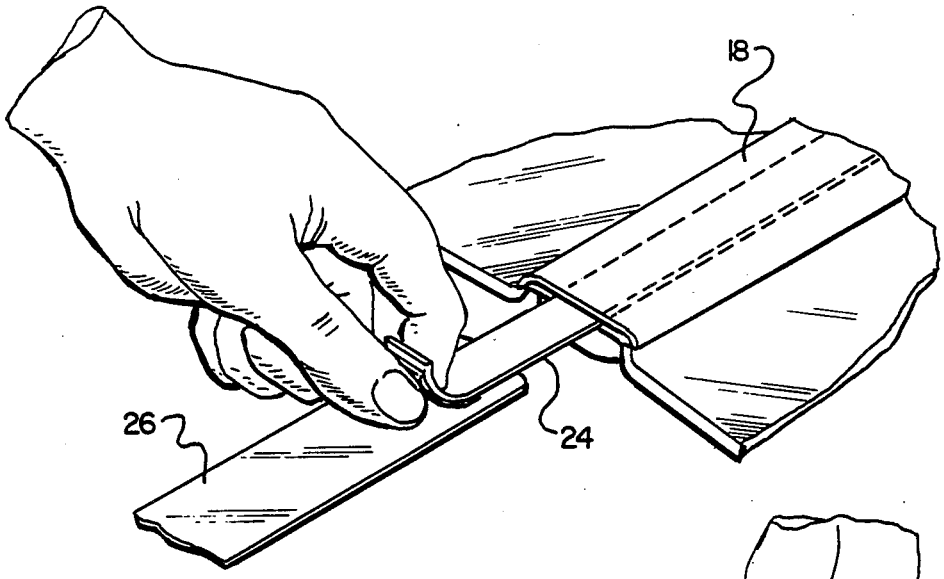
FIG. 6 is a fragmentary isometric view of a label being attached to the leader.

The present invention is an improved system for labeling the spine of bound works. The bound work to be labeled, as illustrated in FIG. 1, is comprised of a spine 2 with a pair of parallel longitudinal edges 4 and 6 and a pair of parallel transverse edges 8 and 10. Front and rear covers 12 and 14, respectively, are attached to the spine along each longitudinal edge with hinges 16 located between each cover and the spine 2.

Figure 7:
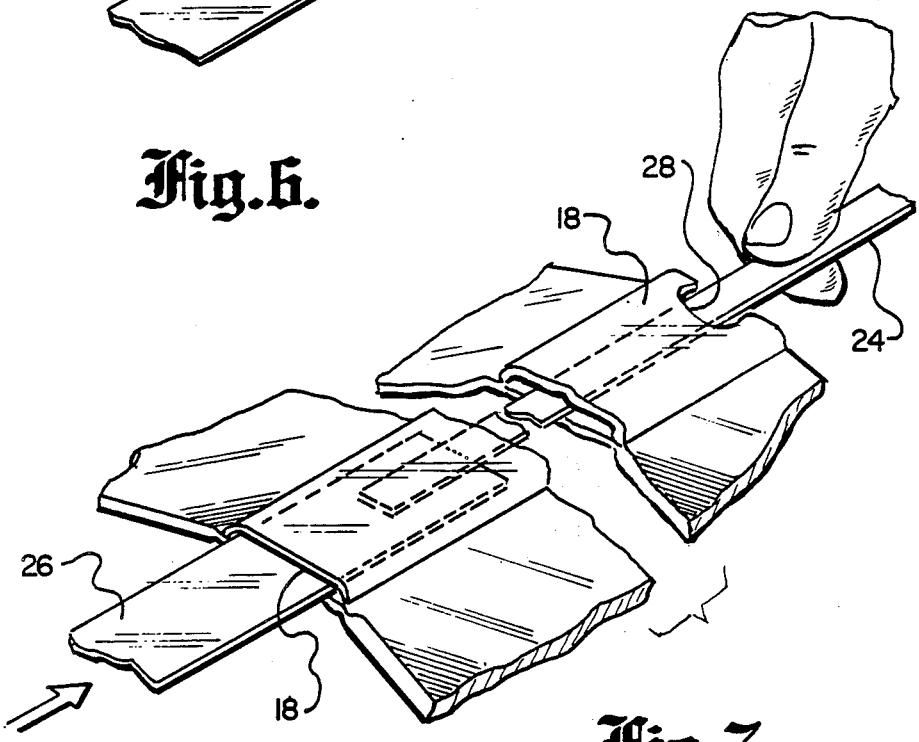
FIG. 7 is a fragmentary isometric view showing the positioning of a label on the spine of a bound work.

A cover means 18 is located on the spine 2 and sealed to the spine along the longitudinal edges 4 and 6, forming a slot 20 between the spine and the cover means (FIGS. 5, 6 and 7). A leader 22 is located in the slot 20 and extends beyond the non-sealed transverse edges 8 and 10 of the cover means 18. Attaching means 24 (FIGS. 3 and 4) are located near one end of the leader 22 and are intended to attach a label 26 to the leader 22 and allow the leader 22 to pull the label 26 into the slot 20 (FIGS. 6 and 7).

In the preferred embodiment the cover means 18 is an overlay cover, in the form of a transparent plastic sheet, which is sealed to the longitudinal edges 4 and 6 of the spine 2 along the hinges 16 by a high frequency seal. A portion of the bottom transverse edge 10 is also sealed, leaving an unsealed segment 28 near the middle of the lower edge 10 which allows the leader 22 to extend out of the slot beyond the overlay cover 18.

The leader 22 is an elongate member with a width less than the width of the spine 2 and overlay cover 18, as shown in FIGS. 1, 6 and 7. The leader 22 is located in the slot 20 and extends through the non-sealed section 28 of the bottom transverse edge 10 and through the top transverse edge 8 of the overlay cover 18.

The leader 22 contains an adhesive portion 24 near one end (FIGS. 3, 4 and 6). In the preferred embodiment the adhesive portion 24 allows the leader 22 to be releasably attached to a label 26 (FIGS. 6 and 7), pulling the label into the slot 20 and detaching from the label without damaging it. The opposite end of the leader on the reverse side from the adhesive is a waxed surface 30 (FIGS. 3 and 4). The leader is stored by bringing its opposite ends together along the outside of the overlay cover and attaching the adhesive portion 24 to the waxed surface 30, so that the leader extends entirely around the overlay cover as illustrated in FIGS. 1 and 2.

In an alternate embodiment, a detachable cover is positioned over the adhesive portion, as illustrated in FIG. 4, to protect the adhesive portion from contacting foreign material that may effect its ability to adhere.

In the present invention the overlay cover 18 extends beyond the spine 2 to cover the front and back covers 12 and 14, and is high frequency sealed to the bottom and side edges of the covers. The top edges of the front and back covers are not sealed, allowing additional labels to be inserted into the area between the overlay cover and the covers if desired. A high frequency seal is a conventional process that involves agitating the molecules of the polymer material that make up the outer surfaces of the binder and causing these molecules to interact, forming a weld between the several layers of material.

The present system is assembled by placing the leader 22 longitudinally along the spine 2 of the bound work. The overlay cover 18 is placed over the bound work and is sealed along the longitudinal edges 4 and 6 of the spine and the side and bottom edges of each cover 12 and 14, leaving a non-sealed segment 28 along the bottom transverse edge 10 of the spine 2 through which the leader 22 can be pulled (FIGS. 1 and 7).

A label 26 or other identifying means is attached to the adhesive portion 24 on the end of the leader 22, as shown in FIG. 6. When the leader 22 is pulled through the non-sealed segment 28 of the bottom transverse edge 10, the label 26 is consequently pulled through the top transverse edge 8 of the overlay cover 18 into the slot 20 (FIG. 7). The leader 22 and the label 26 are pulled through the slot until the label is positioned at a desired location. Finger pressure is then placed on the label 26 via the overlay cover 18 to ensure that the label remains in place, and the force on the leader is continued until it detaches from the label.

When desired, the label 26 can be removed from the slot 20 in a similar fashion. The adhesive portion 24 of the leader 22 is inserted into the slot until it attaches to the label; finger pressure may be applied to secure the attachment. The label is then removed from the slot 20 by pulling the leader through the top transverse edge.

An apparatus and system for labeling the spine of a bound work has been shown and described which is highly effective. As numerous modifications and alternate embodiments of the invention will occur to those skilled in the art, it is intended that the invention be limited only in terms of the appended claims.

I claim:

1. An improved system for labeling the spine of bound works in combination with a bound material, said bound works comprising a spine with a pair of generally parallel longitudinal edges and a pair of generally parallel transverse edges, and front and back covers attached to the longitudinal edges of the spine, and wherein the improvement comprises:

a transparent cover means attached to the spine adjacent to its longitudinal edges and separated from the spine therebetween, whereby a space is formed between the transparent cover and the spine of the bound work; and an elongated leader having a lesser width than the space along the spine and adapted to be positioned in that said space between the transparent cover and the spine, said leader when so positioned extending at each end of the spine, one end of the leader being adapted to be removably attached to a label and the other end being adapted to be grasped manually to pull the leader for positioning the removably attached label inside the said space, and thereby permit the viewing of the label placed therein.

2. The system as defined in claim 1, wherein a sealing means fixes the cover means to the spine of the bound work along its longitudinal edges.

3. The system as defined in claim 2, wherein the sealing means is a high frequency sealer.

4. The system as defined in claim 2, wherein the cover means is unsealed with respect to the spine at its transverse ends.

5. The system as defined in claim 1, wherein the leader is provided with an adhesive portion at one end for attaching to a label.

6. The system as defined in claim 5, wherein the leader is adapted to be detached from a label without damaging the label.

7. The system as defined in claim 5, wherein the leader includes a detachable cover positioned over the adhesive portion and adapted to be peeled off to expose the adhesive when it is desired to use the leader.

8. The system as defined in claim 5, wherein the leader is longer than twice the length of the spine cover means, extends through the slot and is folded back at each end of the cover means so that the opposite ends of the leader overlap outside the cover means, the adhesive portion of the leader detachably adhering to the opposite end of the leader.

9. The system as defined in claim 5, wherein the adhesive portion has a sufficiently strong adhesion to draw an attached label into the slot, but is weak enough for the adhesion to be broken in response to finger pressure on a label within the slot and pulling on the opposite end of the leader.

10. The system of claim 1, wherein the outer cover means extends beyond the spine and is sealed to the bound work in the vicinity of the front and back cover edges.

* * * * *